US007159505B2

(12) United States Patent
Trendall

(10) Patent No.: US 7,159,505 B2
(45) Date of Patent: Jan. 9, 2007

(54) HYDRAULIC BREECH MECHANISM FOR FIREARMS

(76) Inventor: Simon Trendall, 15 Waterloo Road, Crowthorne, Berkshire (GB) R8 457 PB ( * ) Notice: Subject to any disclaimer, the term of this patent is extended or adjusted under 35 U.S.C. 154(b) by 0 days.

(21) Appl. No.: 11/348,589

(22) Filed: Feb. 8, 2006

(65) Prior Publication Data

US 2006/0185507 A1 Aug. 24, 2006

(30) Foreign Application Priority Data

Feb. 23, 2005 (GB) ..... 0503716.3

(51) Int. Cl.
*F41A 5/00* (2006.01)

(52) U.S. Cl. ..... 89/193; 89/191.01; 89/43.01

(58) Field of Classification Search ..... 89/193, 89/191.01, 43.01, 162, 170; 42/14; 124/73–74
See application file for complete search history.

(56) References Cited

U.S. PATENT DOCUMENTS 2,720,820 A * 10/1955 Dixon et al. ..... 89/173

3,336,838 A * 8/1967 Wilson ..... 89/197

* cited by examiner

*Primary Examiner*—Stephen M. Johnson
*Assistant Examiner*—Gabriel J. Klein

(57) ABSTRACT

A hydraulic breech mechanism uses a sealed reservoir of fluid to rigidly support the bolt 6 against barrel 2 resisting pressure generated by discharging a cartridge in chamber 3. Recoil forces cause the high pressure cylinder 7 and barrel assembly 2 and 4 to move relative to the sleeve valve 8 opening communication between reservoirs 9 and 11. This and subsequent bolt travel displace floating piston 12 compressing spring 13. During bolt opening any cartridge in chamber 3 will be ejected. With the firing load removed from the bolt 6 the floating piston 12 under influence of spring 13 will pump fluid into the high pressure reservoir 9, closing the bolt and chambering any round in the loading port. Continued load from spring 13 now returns the high pressure cylinder 7 and barrel assembly 2 and 4 to the original position relative to the sleeve valve locking bolt 6 ready for the next cycle.

6 Claims, 4 Drawing Sheets

HYDRAULIC BREECH MECHANISM FOR FIREARMS

Figure 1:
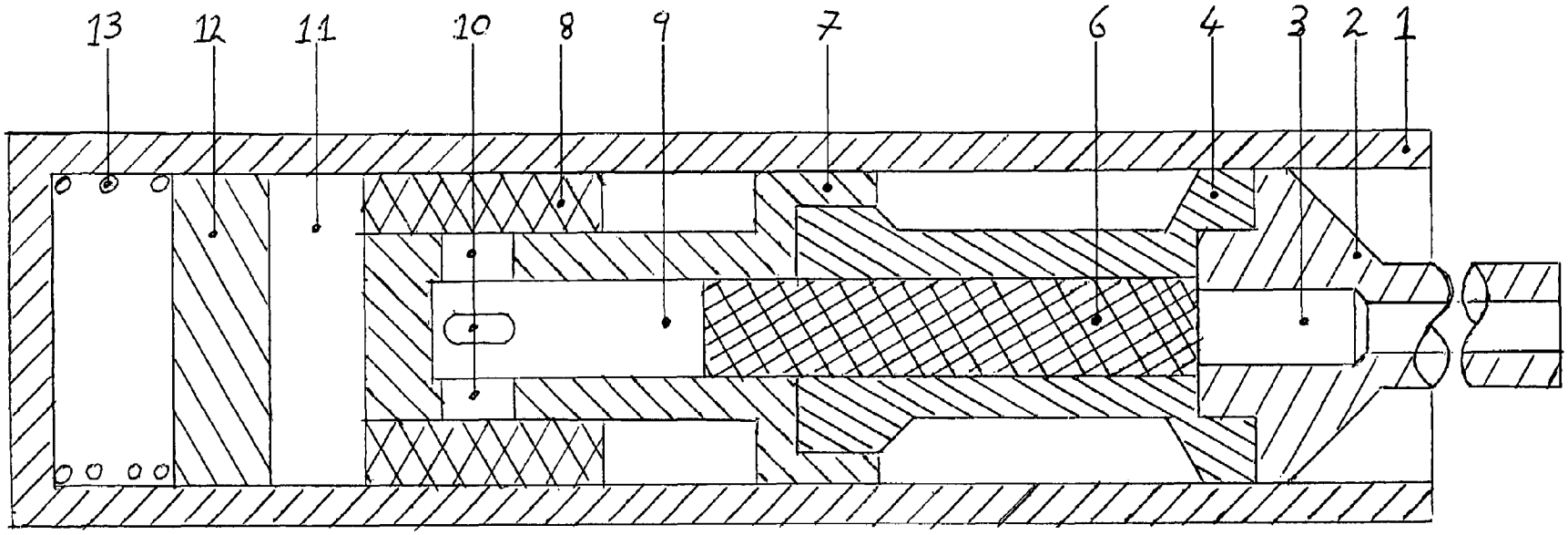

The present invention relates to a hydraulically locked breech mechanism for high power firearms of all classes.

A typical firearm has a barrel with a chamber for a cartridge and a bolt or breech block to lock the cartridge in the chamber for firing and until the pressure in the chamber has dropped, after firing, to a level at which it is safe to unlock the breech mechanism. For safe and reliable operation it is essential that the bolt or breech block and barrel are locked together to support the cartridge during firing. Failure of the cartridge case can occur if the bolt or breech block and barrel are not rigidly locked together. Typically a mechanical interlock or abutment is used to achieve this locking.

A major disadvantage is the complexity of form of these locking members and the need to manufacture such complex forms to close tolerances.

Another disadvantage is that the complex forms of the moving parts make sealing the mechanism against the ingress of foreign matter, such as sand or mud, extremely difficult and any such matter can render the locking mechanism inoperable.

According to the present invention there is provided a hydraulic breech mechanism comprising a low pressure reservoir for fluid having communication with a high pressure reservoir for fluid and a sealing means moveable between a sealed position isolating the two reservoirs to allow the fluid sealed in the high pressure reservoir to rigidly lock the bolt or breech block in relation to the barrel and an open position permitting communication between the two reservoirs thus allowing the bolt or breech block to travel in relation to the barrel.

By using fluid in this way the number and complexity of parts is significantly reduced.

Another advantage is the cylindrical form of the parts means sealing against ingress of foreign matter simple A further advantage due to the combination of in line hydraulics and floating piston assembly is a significant reduction in recoil transmitted to the operator.

In one embodiement the sealing means seperating the high and low pressure reservoirs is a sleeve valve, concentric with the high pressure reservoir and secured to the outer casing. Recoil forces move the assembly comprising the high pressure cylinder, bolt, barrel extension and barrel through the sleeve valve to open the ports communicating between high and low pressure reservoirs. A floating piston assembly, forming one end of the low pressure reservoir allows for the displacement of fluid caused by this travel and by the travel of the bolt subsequent to this, the spring in the floating piston assembly provides the force to return the bolt and seal the high pressure reservoir.

In a second embodiement the sleeve valve is permited limited travel enabling it to function as a floating piston. As the high pressure cylinder, bolt, barrel extension and barrel move rearward during recoil the sleeve valve moves forward compressing a return spring against the barrel extension.

In a third embodiement direct or indirect action of gas pressure generated by discharge of the cartridge moves the sleeve valve to open the ports. The present invention is applicable to a wide range of weapons from rifles to artillery.

The present invention will now be described by way of example with reference to the accompanying drawings in which:

FIG. 1: Is a schematic cross section through the locked breech mechanism

Figure 2:
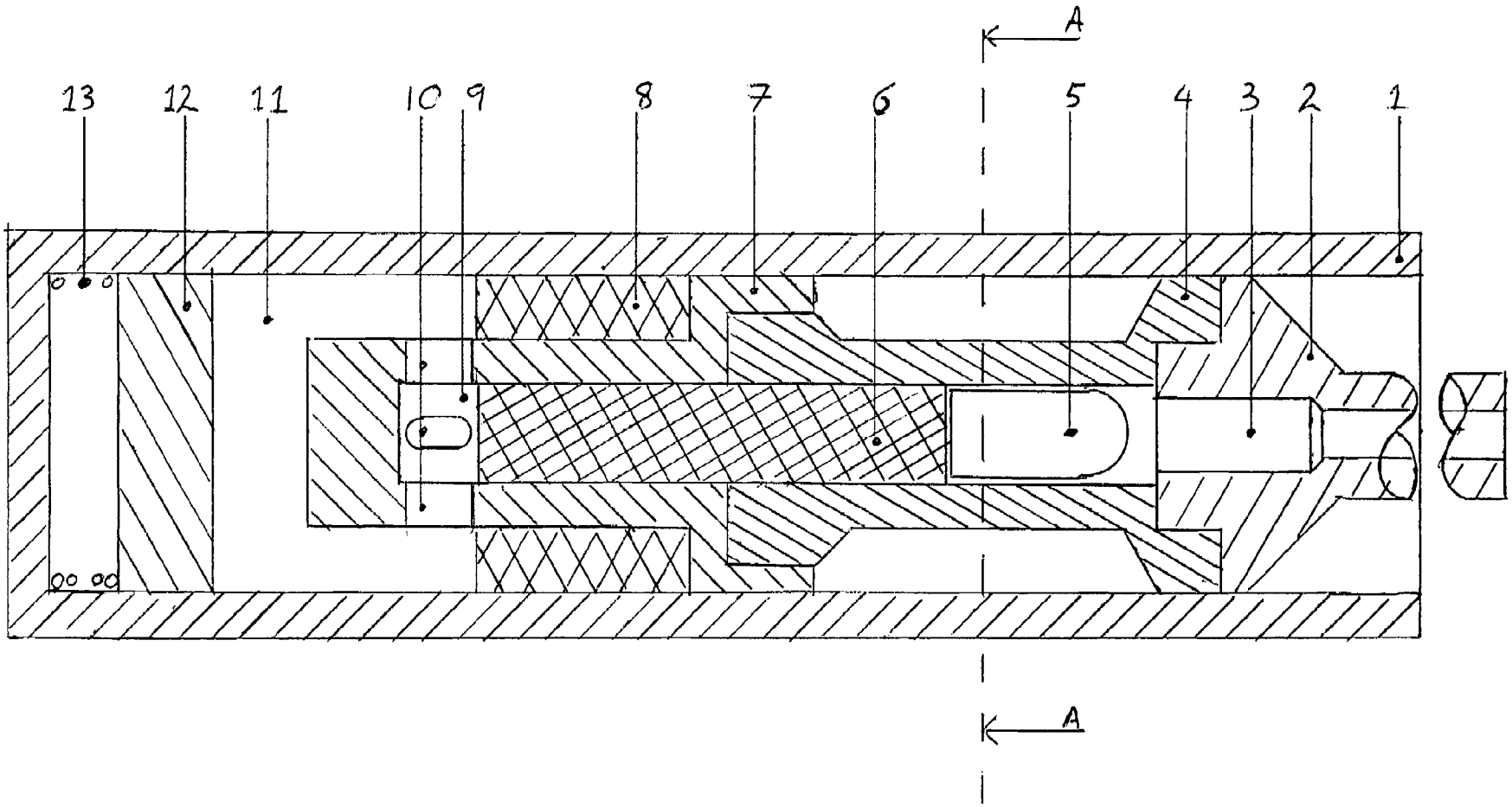

FIG. 2: Is a schematic cross section through the open breech mechanism.

Figure 3:
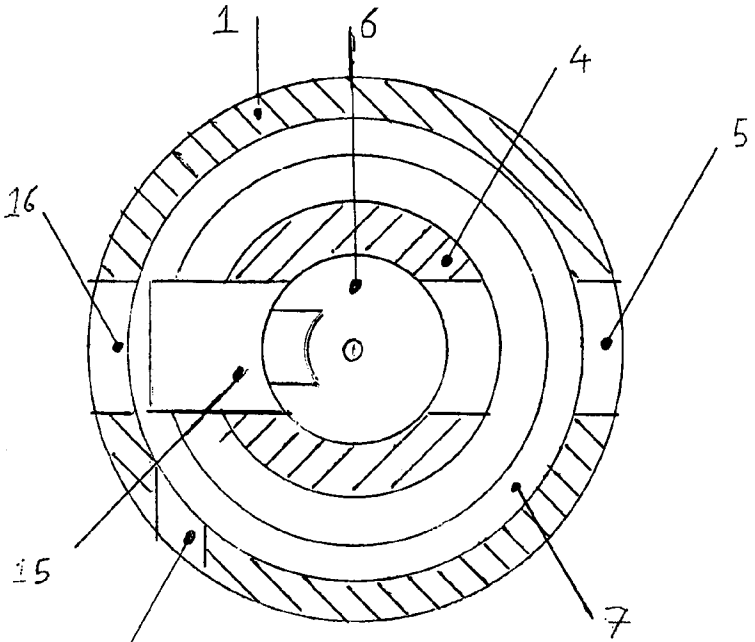

FIG. 3: Is a schematic cross section through the open breech mechanism along the line A—A.

Figure 4:
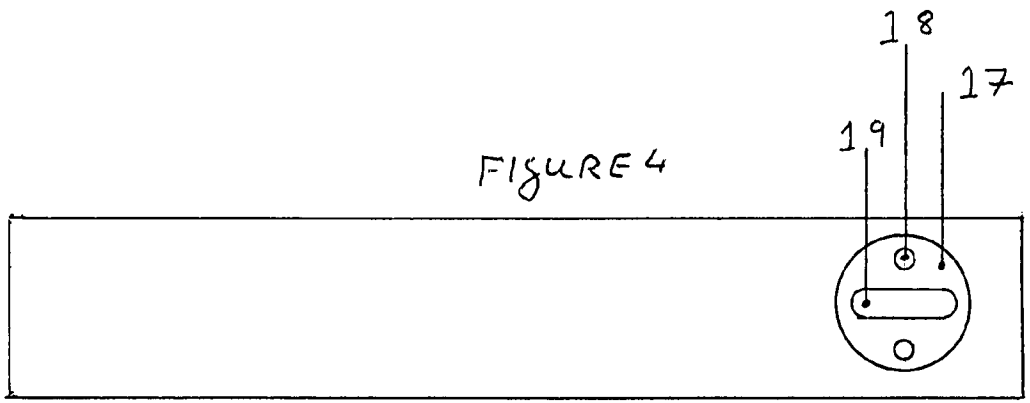

FIG. 4: Shows the bolt head reccess for the operating link.

Figure 5:
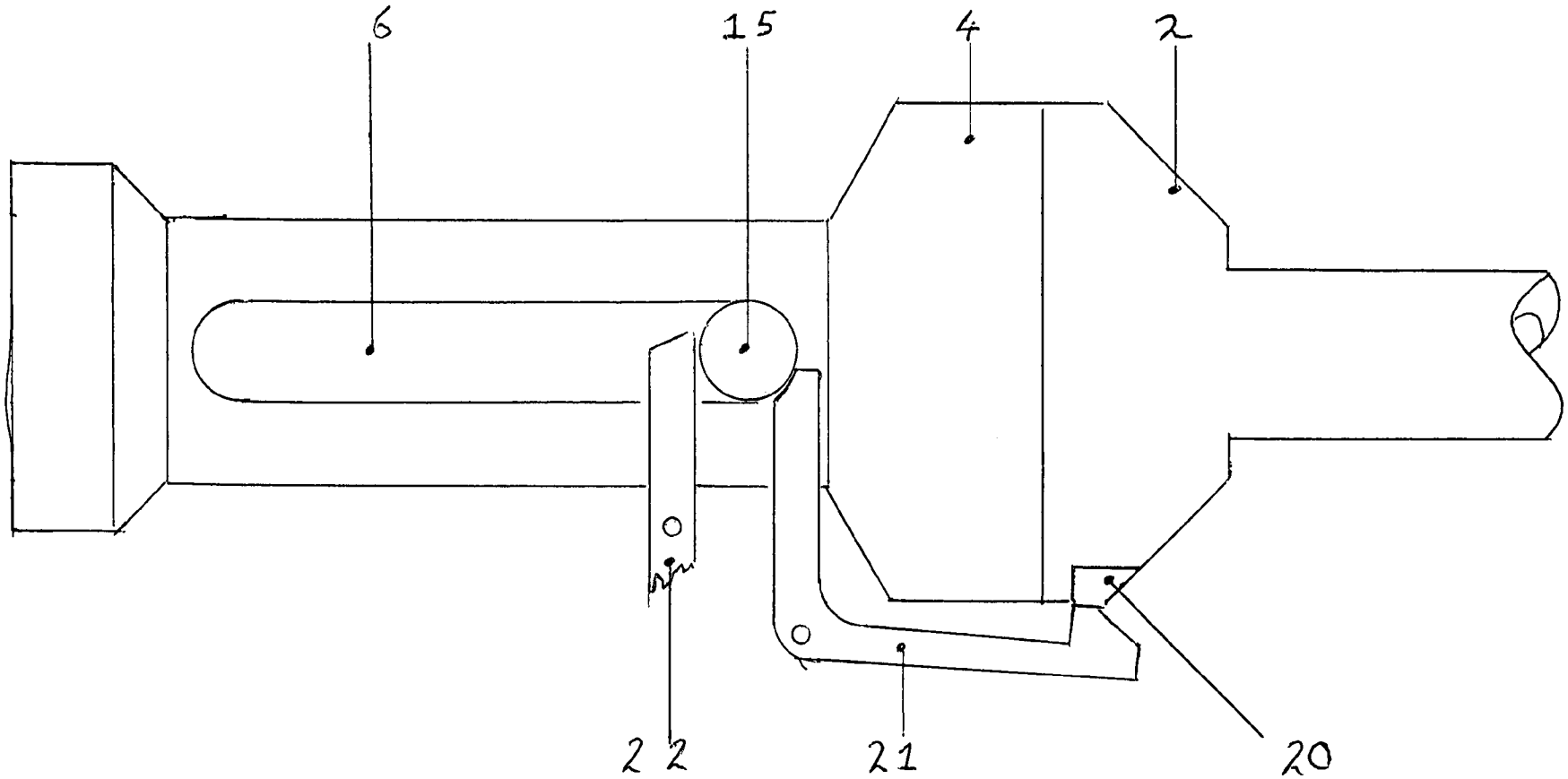

FIG. 5: Is a view showing the mechanical timing of breech closure and the firing line.

A hydraulic breech mechanism according to the present invention is shown in FIG. 1 and comprises an outer casing 1 defining a low pressure reservoir 11, a floating piston assembly comprising a piston 12 and a spring 13, a high pressure cylinder 7 defines a high pressure reservoir 9 and a sleeve valve 8 closes ports 10 seperating high pressure reservoir 9 from low pressure reservoir 11. The fluid sealed in the high pressure reservoir will lock the bolt 6 in relation to the barrel 2 supporting a cartridge in chamber 3.

On discharge of a cartridge in chamber 3 gas pressure generated by the combustion of propellant in the cartridge will exert a force on bolt 6. The barrel 2, barrel extension 4, bolt 6 and high pressure cylinder 7 are locked in a fixed relationship to each other. The force on the bolt 6 caused by discharge of a cartridge in chamber 3 will move the assembly comprising barrel 2, barrel extension 4, bolt 6 and high pressure cylinder 7 toward the floating piston 12, displacing fluid in low pressure reservoir 11 and compressing spring 13. After a delay to allow the gas pressure in chamber 3 to drop to safe levels the ports 10 will clear the sleeve valve 8, allowing communication between the high pressure reservoir and the low pressure reservoir to be established. The delay to allow the gas pressure in chamber 3 to drop to safe levels is caused by the travel of the high pressure cylinder 7 through the sleeve valve 8 before the ports 10 clear the sleeve valve 8. When the ports 10 have cleared the sleeve valve 8 a catch 21 engages the barrel 2 and holds the barrel 2, barrel extension 4 and high pressure cylinder 7 against the load of spring 13. With the high pressure reservoir 9 and the low pressure reservoir 11 in communication via ports 10 the bolt 6 is no longer locked in relation to the barrel 2 a combination of inertia and residual gas pressure in chamber 3 will cause the bolt 6 to move toward the low pressure reservoir 11 and reach the position shown in FIG. 2, pumping fluid from high pressure reservoir 9 through the ports 10 into the low pressure reservoir 11 further loading spring 13. During this travel of the bolt 6 any cartridge in chamber 3 will be extracted and ejected through ejection port 16, a new cartridge may now be placed in loading port 5.

The position shown in FIG. 2 is now reached with the bolt 6 stationary at and the spring 13 under peak load. The spring 13 exerts a force on the bolt 6 via the floating piston 12 and the fluid in the inerconnecting reservoirs 9 and 11. The bolt 6 is pushed toward the barrel 2, if a cartridge is in the loading port 5 it will be pushed into the chamber 3 by the bolt 6. As the bolt 6 contacts the barrel 2 it will move catch 21 releasing the assembly comprising the high pressure cylinder 7, bolt 6, barrel extension 4 and barrel 2. The spring 13 can now push this assembly back into the locked position, with the sleeve valve 8 isolating the high pressure reservoir 9 from the low pressure reservoir 11 and locking the bolt 6 in relation to the barrel ready for the next cycle. It is essential to prevent the bolt 6 from rotating in the barrel extension 4 so as to preserve the relationship of the extractor and ejector mounted in the bolt face and the ejection port 16. This task is performed by a link 15 comprising a tube secured in reccess 17 at the front of bolt 6. The link 15 passes through the ejection port in the side of barrel extension 4. Link 15 also acts on catch 21 on the bolt 6 closing to the locked position and on the opening or unlocking part of the cycle link 15 can reset the hammer 22 and so the firing mechanism via slot 14. The hammer strikes a transfer bar in link 15, that penetrates the bolt 6 at slot 19 to operate the firing pin discharging any cartridge in chamber 3.

The invention claimed is:

1. A hydraulic breech mechanism comprising a low pressure reservoir for fluid having communication with a high pressure reservoir for fluid and a sealing means movable between a sealed position isolating the two reservoirs to allow the fluid sealed in the high pressure reservoir to rigidly lock a bolt or breech block in relation to a barrel and an open position permitting communication between the two reservoirs thus allowing the bolt or breech block to travel in relation to the barrel.

2. A hydraulic breech mechanism as claimed in claim 1 wherein the sealing means or seperating the two reservoirs is a sleeve valve concentric with the high pressure reservoir.

3. A hydraulic breech mechanism as claimed in claim 2 wherein the sleeve valve is fixed in relation to the low pressure reservoir with the high pressure reservoir, bolt, a barrel extension and barrel free to travel in relation to the sleeve valve to open or close communication between the two reservoirs.

4. A hydraulic breech mechanism as claimed in claim 2 wherein the high pressure reservoir, a barrel extension and barrel are fixed in relation to the low pressure reservoir with the sleeve valve and bolt being manipulated by an operator.

5. A hydraulic breech mechanism as claimed in claim 2 wherein the high pressure reservoir, barrel extension and barrel are fixed in relation to the low pressure reservoir with the sleeve valve operated by direct or indirect gas pressure generated by discharging a cartridge.

6. A hydraulic breech mechanism as claimed in claim 2 wherein the low pressure reservoir is concentric and axially aligned with the high pressure reservoir and sleeve valve with one end of the low pressure reservoir formed by a floating piston assembly and the opposite end formed by the sleeve valve and high pressure reservoir.

* * * * *